US010538822B2

(12) United States Patent
Polak

(10) Patent No.: US 10,538,822 B2
(45) Date of Patent: Jan. 21, 2020

(54) CONVEYANCE SYSTEM FOR TENSIONING IN ORDER TO POST-TREAT A RAPIDLY-SOLIDIFIED METAL STRIP, AND POST-TREATMENT METHOD

(71) Applicant: Vacuumschmelze GmbH & Co. KG, Hanau (DE)

(72) Inventor: Christian Polak, Blankenbach (DE)

(73) Assignee: VACUUMSCHMELZE GMBH & CO. KG, Hanau (DE)

( * ) Notice: Subject to any disclaimer, the term of this patent is extended or adjusted under 35 U.S.C. 154(b) by 600 days.

(21) Appl. No.: 15/051,445

(22) Filed: Feb. 23, 2016

(65) Prior Publication Data

US 2016/0251738 A1 Sep. 1, 2016

(30) Foreign Application Priority Data

Feb. 26, 2015 (DE) ..... 10 2015 102 765

(51) Int. Cl.

| | |
|---|---|
| ***C21D 9/56*** | (2006.01) |
| ***C21D 8/02*** | (2006.01) |
| ***C22C 38/16*** | (2006.01) |
| ***C22C 38/12*** | (2006.01) |
| ***C22C 38/02*** | (2006.01) |
| ***C22C 38/00*** | (2006.01) |

(52) U.S. Cl.
CPC ..... *C21D 8/0252* (2013.01); *C21D 8/0205* (2013.01); *C21D 9/56* (2013.01); *C22C 38/002* (2013.01); *C22C 38/02* (2013.01); *C22C 38/12* (2013.01); *C22C 38/16* (2013.01)

(58) Field of Classification Search
CPC ..... C21D 8/0252; C21D 9/56; C21D 8/0205; C21D 9/66; C21D 8/0206
See application file for complete search history.

(56) References Cited

U.S. PATENT DOCUMENTS

| | | | | |
|---|---|---|---|---|
| 4,288,260 | A | 9/1981 | Senno et al. | |
| 4,539,830 | A | 9/1985 | Noe et al. | |
| 5,069,428 | A | 12/1991 | Li et al. | |
| 7,905,966 | B2 | 3/2011 | Waeckerle et al. | |
| 9,327,907 | B1 * | 5/2016 | Schiltz | B65G 39/07 |
| 2008/0196795 | A1 | 8/2008 | Waeckerle et al. | |
| 2013/0139929 | A1 | 6/2013 | Francoeur et al. | |
| 2014/0097286 | A1 | 4/2014 | Francoeur et al. | |
| 2015/0243435 | A1 | 8/2015 | Polak | |

FOREIGN PATENT DOCUMENTS

| | | | |
|---|---|---|---|
| CN | 2282543 | Y | 5/1998 |
| CN | 101371321 | A | 2/2009 |
| CN | 102812134 | A | 12/2012 |
| CN | 202741485 | U | 2/2013 |
| CN | 103189152 | A | 7/2013 |
| CN | 103547523 | A | 1/2014 |
| CN | 203568366 | U | 4/2014 |
| DE | 3234160 | A1 | 3/1984 |
| DE | 10218959 | B4 | 7/2011 |
| EP | 2623221 | A1 | 8/2013 |
| WO | 2013156010 | A1 | 10/2013 |

OTHER PUBLICATIONS

"Mechanical Equipment Design of Strip Workshop, vol. 2" Aug. 31, 1984, Wuhan Iron & Steel Design & Research Institute of Ministry of Metallurgical Industry, Metallurgical Industry Press.
"Mechanical Design (16th edition)" Mar. 31, 2012, D. Muhs et al., China Machine Press.

* cited by examiner

*Primary Examiner* — Jessee R Roe
(74) *Attorney, Agent, or Firm* — Dickinson Wright PLLC

(57) ABSTRACT

Conveyance system for tensioning in order to post-treat a rapidly-solidified metal strip, and post-treatment method is provided. The invention relates to a conveyance system (1 to 5) for tensioning in order to post-treat a rapidly-solidified metal strip (6), and a post-treatment method. For this purpose, the conveyance system comprises a tension roller assembly (6 to 11) and a tensioning assembly (12), between which the metal strip (6) is conveyed in order to be continuously post-treated under a predetermined tensile stress. The tension roller assembly (6 to 11) comprises a single drive roller (13) and a freely-rotating pressing roller (14). The metal strip (6) is conveyed over an angle of wrap $\alpha$ on the drive roller, and, with respect to the drive roller (13), the pressing roller (14) is arranged at a contact point (16) of the metal strip (6) that defines one end of an angle of wrap $\alpha$.

12 Claims, 3 Drawing Sheets

CONVEYANCE SYSTEM FOR TENSIONING IN ORDER TO POST-TREAT A RAPIDLY-SOLIDIFIED METAL STRIP, AND POST-TREATMENT METHOD

This US patent application claims priority to German patent application no. 10 2015 102 765.8, filed Feb. 26, 2015, the entire content of which is incorporated herein by reference.

BACKGROUND

1. Field

The invention relates to a conveyance system for tensioning in order to post-treat a rapidly-solidified metal strip, and to a post-treatment method. For this purpose, the conveyance system comprises a tension roller assembly and a tensioning assembly, between which the metal strip is conveyed in order to be continuously post-treated under a predetermined tensile stress.

2. Related Art

U.S. Pat. No. 7,905,966 B2 discloses a method for producing a strip of nanocrystalline material, wherein the metal strip is conveyed through a continuous furnace under a predetermined tensile stress. In order to obtain this tensile stress in an upright manner, the known conveyance system comprises a roller pair in a direction of conveyance or direction of passage, as a tensioning assembly, at the beginning of the post-treatment region, wherein the two rollers are arranged vertically one above the other, wherein the metal strip to be post-treated rests in the shape of an S on the roller pair.

An additional two rollers of a tension roller pair are arranged vertically one over the other after the post-processing region in the direction of passage, and form a tension roller assembly composed of a drive roller and a pressure roller having dimensions identical to those of the drive roller, for continuous conveyance of the metal strip. The post-treated metal strip is again guided in an S-shaped manner at this tension roller assembly. Therefore, this known conveyance system having a pair of rollers that are arranged vertically one above the other before and after the post-treatment region of the metal strip is called a known S-roller system.

Because the metal strip is conveyed through the system while under tensile stress, cracking may occur in the strip, which is undesirable.

SUMMARY

The present invention therefore addresses the problem of providing a conveyance system with which the likelihood that a metal strip could be torn off is reduced.

This problem is solved according to the invention by means of a conveyance system for tensioning in order to post-treat a rapidly-solidified metal strip according to the subject matter of claim 1, as well as by means of a method for post-treating the rapidly-solidified metal strip according to the subject matter of claim 15. Advantageous developments of the invention are made apparent by the accompanying dependent claims and the use claims 13 and 14.

In one embodiment of the invention, a conveyance system for tensioning in order to post-treat a rapidly-solidified metal strip comprises a tensioning assembly and a tension roller assembly, between which the metal strip is conveyed in order to be continuously post-treated under a predetermined tensile stress. The tension roller assembly comprises a single drive roller and a freely-rotating pressing roller. The tensioning assembly may include a braking function. The metal strip is conveyed over an angle of wrap $\alpha$ on the drive roller, and, with respect to the drive roller, the pressing roller is arranged at a contact point of the metal strip that defines one end of an angle of wrap $\alpha$.

Such a conveyance system for tensioning in order to post-treat a rapidly-solidified metal strip is advantageous in that the arrangement of a freely-rotating pressing roller makes it possible to very precisely adjust the tensile stress acting on the metal strip in the post-treatment region, because the end of the angle of wrap $\alpha$ of the metal strip can be very precisely adjusted via the freely-rotating pressing roller.

If, in one embodiment of the invention, the first contact point of the metal strip on the drive roller corresponds exactly to the end of the angle of wrap $\alpha$, then the pressing roller is touched by the metal strip only in a line, transversely to the circumference of the drive roller and the pressing roller, at an angle of wrap $\alpha=0$, such that the tensile force acting on the metal strip to be post-treated is equal to a holding force $F_A^0$ at an angle of wrap $\alpha=0$. If, however, the position of the pressing roller is shifted relative to the first contact point of the metal strip on the drive roller, then an additional static holding force $F_R$ is added to the holding force $F_A^0$. Only when this additional static holding force $F_R$ is overcome does the frictional system transition into sliding friction, such that the required tensile force $F_z$ can no longer be applied through the conveyance system and a "slipping through" of the metal strip is the result, such that it is no longer possible to maintain the adjusted tensile force $F_z$ and thus the required tensile stress in the continuous metal strip.

Another embodiment of the invention provides that the angle of wrap $\alpha$ of the metal strip on the drive roller comprises between 0 and 180°. In the case where the angle of wrap $\alpha=180°$, the metal strip wraps around half of the circumference of the drive roller, because the pressing roller, relative to the first contact point of the metal strip on the drive roller, is displaced by 180° relative to the first contact point. An S-shaped wrapping around of the metal strip of an S-roller conveyance system—as is illustrated with FIG. 1 of the prior art—and contact by the metal strip is reduced by half. Nevertheless, tests have shown that a tensile stress of 1500 MPa on appropriate metal alloy strips up to 19 μm thick and 12 mm wide can be achieved without "slipping through."

Another embodiment of the invention provides limiting the angle of wrap $\alpha$ of the metal strip on the drive roller to up to 40°, because the correspondingly achievable maximum tensile forces of $F_z \leq 120$ N are adequate for magnetic applications, and the frequency of breaks in this range is particularly small. For example, for an Fe-based alloy (VP800, $Fe_{Rest}$, $Cu_1$, $Nb_3$, $Si_{15.6}$, $B_{6.6}$, at %) at a width of 6 to 12 mm, it is possible to achieve a minimum permeability of $\mu=60$ with a continuous heat treatment in the aforementioned angle-of-wrap range of $\alpha$ up to 40°.

In another embodiment of the invention, in contrast to the so-called S-roller system, the pressing roller is arranged so as to freely rotate at a contact point of the metal strip on the end of the angle of wrap $\alpha$ of the metal strip on the drive roller. The pressing roller may then have a significantly smaller radius than the drive roller, as well as a significantly smaller width than the drive roller, in contrast to the S-roller system known in the prior art, with which both the radius and width of the rollers of the respective roller pairs that press onto one another and are frictionally coupled via the metal strip arranged therebetween are equal.

Another embodiment of the invention provides that the drive roller, the pressing roller, and the metal strip have a width $b_{Ra}$, a width $b_{R1}$, and a width $b_{Band}$, respectively, and these widths are in the following relationship: $b_{Ra}>b_{R1}>b_{Band}$. Because the pressing roller is freely rotating and need not be wrapped around by the metal strip at an angle of 180°, as would be the case in the prior art, the pressing roller can have an arbitrarily small radius, independently of the minimum allowable radius of curvature of the metal strip; at the pressing roller, it is particularly essential to exactly define the end of the angle of wrap, and this is facilitated by a small radius. In addition, with the conveyance system according to the invention, it is not necessary for the pressing roller to have the same coefficient of friction as the drive roller in order to prevent premature "slipping through" of the strip.

Another embodiment of the invention provides that the pressing roller has a steel alloy in a peripheral region thereof, while the drive roller has a plastic material that is known as FRIBOFLEX in a peripheral region thereof, in order to ensure a suitable coefficient of friction. With an angle of wrap $\alpha>0$, an additional frictional force $F_R$ that acts in the same direction as the holding force $F_A^0$ when the angle of wrap $\alpha=0$ is established or induced in the metal strip. The now effectively acting holding force $F_A$ results from the sum:

$$F_A=F_A^0+F_R \tag{1}$$

where $F_A$ is an effectively active force on the metal strip, $F_A^0$ is a force on the metal strip when the angle of wrap $\alpha=0$, and $F_R$ is a static holding force on the metal strip when the angle of wrap $\alpha$ is >0.

The static holding force $F_R$ can be calculated by calculating the wrapping friction or cable friction of a flexible traction mechanism. It is also necessary to know the coefficient of sliding friction ($\eta$) on the drive roller 13 from, for example, the plastic material FRIBOFLEX for the metal alloy material. For such an assembly, it is possible to experimentally determine a coefficient of sliding friction ($\eta$) of, for example, 0.32 for the material combination of the plastic roller and the metal strip. This brings the frictional force of $F_R$ to:

$$F_R=F_z(1-1/(e^{\eta\alpha[rad]}) \tag{2}$$

$F_z$ then represents the tensile stress in the strip; with $\alpha$, the angle of wrap in radians is:

$$\alpha[\text{rad}]=\alpha[°]\cdot 2\pi/360 \tag{3}$$

The additional frictional force thus depends on the tensile stress in the strip and on the angle of wrap $\alpha$. For $\alpha=0°$, the frictional force $F_R$ disappears. For high $\alpha$ values, $F_R$ approaches the tensile force $F_z$ in the strip. Thus, the tensile force $F_z$ in the strip can be increased to an equilibrium state $F_z=F_A$ with $F_A=F_A^0+F_R$ before there is a "slipping through." It is thus possible to realize higher tensile forces in the strip, relative to when the angle of wrap $\alpha=0$; in the case of a magnet, it is also possible to induce higher anisotropies or achieve a lower material permeability. As long as an angle of wrap $\alpha$ that is not too high is selected, there will also be no significant increase in the frequency of breaks in a preferable angle-of-wrap range of up to 40°.

It may furthermore be provided that the tensioning assembly and the tension roller assembly have an identical construction with pressing rollers, and, in place of the drive roller, the tensioning assembly has a brake roller of the same material and of the same size as the drive roller on the other side. Such a conveyance system is extremely cost-efficient, because the construction of the tensioning assembly before the post-treatment region and the tension roller assembly behind or after the post-treatment region is identical, and constructed out of identical materials and components.

In another preferred conveyance system, the pressing rollers have a contact pressure force in the range of 15 to 150 N with surface pressures of 7 to 10 MPa, which act on the drive roller and/or on the brake roller.

Another embodiment of the invention provides arranging an additional deflection roller upwards of the tension roller assembly in the material flow, with which deflection roller the first contact point on the drive roller can be varied, in order to precisely adjust different angles of wrap $\alpha$ of the metal strip on the drive roller. This deflection roller is wrapped around partially by the metal strip, and has a roller radius that is greater than the minimum allowable radius of curvature of the metal strip. In order to adjust the first contact point of the metal strip on the drive roller, the deflection roller 21 therefore has a radius that is significantly greater than that of the pressing roller, which defines the end of the angle of wrap $\alpha$.

Because the drive roller must also have a greater radius than the minimum allowable radius of curvature of the metal strip, the radius of the deflection roller is equal to the radius of the drive roller in one embodiment of the invention. However, the material of the deflection roller need not correspond to the plastic material of the drive roller, but rather the freely-rotating property of the deflection roller can be supported with a stainless steel roller. Nevertheless, the deflection roller and drive roller do not result in the roller pair of an S-roller system known from the prior art, because both rollers (i.e., the deflection roller and the drive roller) are not pressed onto one another with a force $F_s$, because this force is applied only by the pressing roller according to the invention at the end of the angle of wrap $\alpha$.

In another embodiment of the invention, the tensioning assembly has a plurality of deflection rollers, which transfer a gravitational force of a predetermined weight to the metal strip, as a constant tensile force. This embodiment is advantageous in that it is possible to forgo coordinating between the torque of the drive in the tensioning assembly and the torque of the drive in the tension roller assembly, or forgo forming a brake roller in the tensioning assembly. In another embodiment of the invention, the conveyance system made of the tensioning assembly and the tension roller assembly has a tensile stress acting on the metal strip that is up to 1500 MPa, which can be achieved with an angle of wrap $\alpha=180°$. Such a conveyance system can cooperate with a continuous furnace for heat-treating a rapidly-solidified metal strip, in a manner that is advantageous for post-treating the metal strip, wherein the tensioning assembly is arranged in front of the continuous furnace in the direction of passage and the tension roller assembly is arranged after the continuous furnace.

Further provided is a system for post-treating a metal strip, the system comprising the conveyance system according to one of the preceding embodiments, and a continuous furnace for heat-treating the metal strip, wherein the tensioning assembly is arranged in front of the continuous furnace in the direction of passage (A) and the tension roller assembly is arranged after the continuous furnace.

It is also provided that the conveyance system is used for post-treating a rapidly-solidified metal strip of amorphous or nanocrystalline metal alloys, which are used in magnetic or mechanical applications and are known as VITROVAC, VITROPERM, or VITROBRAZE, or as variants thereof.

The metal strip may comprise an alloy, and a composition may be composed of $Fe_{100-a-b-c-d-x-y-z}Cu_aNb_bM_cT_dSi_xB_yZ_z$ and up to 1 atom % of impurities, wherein: M is one or more of the elements Mo, Ta, or Zr; T is one or more of the elements V, Mn, Cr, Co, or Ni; and Z is one or more of the elements C, P, or Ge; and wherein 0 atom %≤a<1.5 atom %, 0 atom %≤b<2 atom %, 0 atom %≤(b+c)<2 atom %, 0 atom %≤d<5 atom %, 10 atom %<x<18 atom %, 5 atom %<y<11 atom %, and 0 atom %≤z<2 atom %.

It is also provided that the conveyance system according to the invention is used to achieve an unusually high anisotropy and an unusually low permeability in amorphous or nanocrystalline metal alloys, which are used in magnetic applications.

In one embodiment, the following elements are predetermined: a desired value of the permeability or of the anisotropy field; a maximum value of a remanence ratio $J_r/J_s$, e.g., of less than 0.1 for applications as a flat hysteresis loop and greater than 0.5 for applications as a Z-shaped hysteresis loop; and a maximum value of a ratio of a coercivity field intensity to an anisotropy field intensity $H_c/H_a$, e.g., an $H_c/H_a$ of less than 10%; as well as an allowable deviation range of each of these values. Magnetic properties of the strip are measured continuously at the exit from the continuous furnace, and when deviations from the allowable deviation ranges of the magnetic properties are found, the tensile stress on the strip is adjusted correspondingly in order to bring the measured values of the magnetic properties back within the allowable deviation ranges.

Another aspect of the invention relates to a method for post-treating a rapidly-solidified metal strip. The first method step relates to inserting the metal strip into a tensioning assembly that is arranged in space and time before a post-treatment region. The next step entails bridging the distance between the tensioning assembly and a tension roller assembly amid the insertion of the metal strip into the tension roller assembly, which is provided in space and in time after a post-treatment region. The metal strip is conveyed between the tensioning assembly and the tension roller assembly, wherein the metal strip is conveyed over an angle of wrap α on the drive roller. The pressing roller is arranged in a contact point of the metal strip with respect to the drive roller, the contact point defining one end of an angle of wrap α. This may be followed by post-treatment of the metal strip under a predetermined tensile stress between the tensioning assembly and the tension roller assembly, with continuous conveyance of the metal strip through the tensioning assembly and the tension roller assembly.

In a start-up phase, a tensile force of the post-treatment method that is greater than a braking action of the braking function of the tensioning assembly is imparted. The braking function of the tensioning assembly may also be entirely omitted in this start-up phase, and a braking action may then be exerted onto the metal strip through the tensioning assembly only in a post-treatment phase. To achieve this braking function of this tensioning assembly, different mechanical scenarios may be applied. One possibility is to provide a brake roller that corresponds in circumference and size as well as in material to the drive roller on the other side, i.e., the tension roller assembly. This brake roller may comprise a variety of braking mechanisms.

It is also possible to provide the brake roller on the side of the tensioning assembly and provide the drive roller on the side of the tension roller assembly with actuators having a torque that differs gradually, so as to exert a braking action on the metal strip. Once a constant conveyance speed is achieved, the braking force and tensile force acting on the metal strip are in equilibrium.

The metal strip is thereby exposed at a constant conveyance speed to a tensile force that induces a tensile stress, wherein the tensile stress results from the quotient of the tensile force and the cross-sectional area of the metal strip. As discussed above, the tensile force depends on one hand on a contact pressure force of a pressing roller at the end of an angle of wrap and an initial holding force resulting from the contact pressure force, and depends on the other hand on the magnitude of the angle of wrap α with which the metal strip follows on the drive roller of the tension roller assembly, under the definition of the end of the angle of wrap, through the pressing roller. There then emerges an additional static holding force that is dependent on this angle of wrap.

In another embodiment of the method, the usability of the conveyance system according to the invention is determined by detecting an optimum range for an angle of wrap α of the metal strip on the drive roller, by means of recording and assessment of a frequency of breaks of the metal strip in relation to the length of the metal strip, which is greater than or equal to 1 km. This determination step gives a clear indication of the productivity, the usability, and the improvement possibilities of the new conveyance method for producing post-treated rapidly-solidified metal alloy strips.

In addition, the method makes it possible to advantageously perform a heat treatment on the metal strip under a predetermined tensile stress in the post-treatment region. With this heat treatment under tensile stress, it is possible to form nanocrystals in a temperature of range of, for example, 670° C. to 690° C., so that a nanocrystalline state is in effect, which is desirable in order to achieve a minimum permeability in the range of μ=60.

In order to vary the passage speeds of the metal strip through the tempering or heat treatment region, it is also possible to use continuous furnaces of different lengths. The effectively active length of continuous furnaces can be between 0.2 and 3 m, such that the metal strip can be moved at throughput speeds of 2 to 30 m/min. The additional variation of the angle of wrap α also makes it possible to cover a broad tensile force range, in order to determine and reduce the optimum number of breaks on the strip lengths in the range of 1000 m.

With a further preferred form of implementation of the method, metal alloy strips of the alloy types of Ni—Fe-based alloys and nanocrystalline Co- or Fe-based alloys are post-treated in the aforementioned tempering temperatures between 670° and 690° C.

In one embodiment, the following elements are predetermined: a desired value of the permeability or of the anisotropy field; a maximum value of a remanence ratio $J_r/J_s$, e.g., of less than 0.11 for applications as a flat hysteresis loop and greater than 0.5 for applications as a Z-shaped hysteresis loop; and a maximum value of a ratio of a coercivity field intensity to an anisotropy field intensity $H_c/H_a$, e.g. of less than 10%; as well as an allowable deviation range of each of these values. Magnetic properties of the metal strip are measured continuously at the exit from the continuous furnace, and when deviations from the allowable deviation ranges of the magnetic properties are found, the tensile stress on the strip is adjusted correspondingly in order to bring the measured values of the magnetic properties back within the allowable deviation ranges.

In another form of implementation of the method, metal alloy strips having the following composition are post-treated:

$$Fe_{100-a-b-c-d-x-y-z}Cu_aNb_bM_cT_dSi_xB_yZ_z$$

with up to 1 atom % of impurities, wherein: M is one or more of the elements Mo, Ta, or Zr; T is one or more of the elements V, Mn, Cr, Co, or Ni; and Z is one or more of the elements C, P, or Ge; and 0 atom %≤a<1.5 atom %, 0 atom %≤b<2 atom %, 0 atom %≤(b+c)<2 atom %, 0 atom %≤d<5 atom %, 10 atom %<x<18 atom %, 5 atom %<y<11 atom %, and 0 atom %≤z<2 atom %.

BRIEF DESCRIPTION OF THE DRAWINGS

The invention shall now be described in greater detail with reference to embodiments depicted in the drawings.

DETAILED DESCRIPTION OF EXAMPLE EMBODIMENTS

Figure 1:
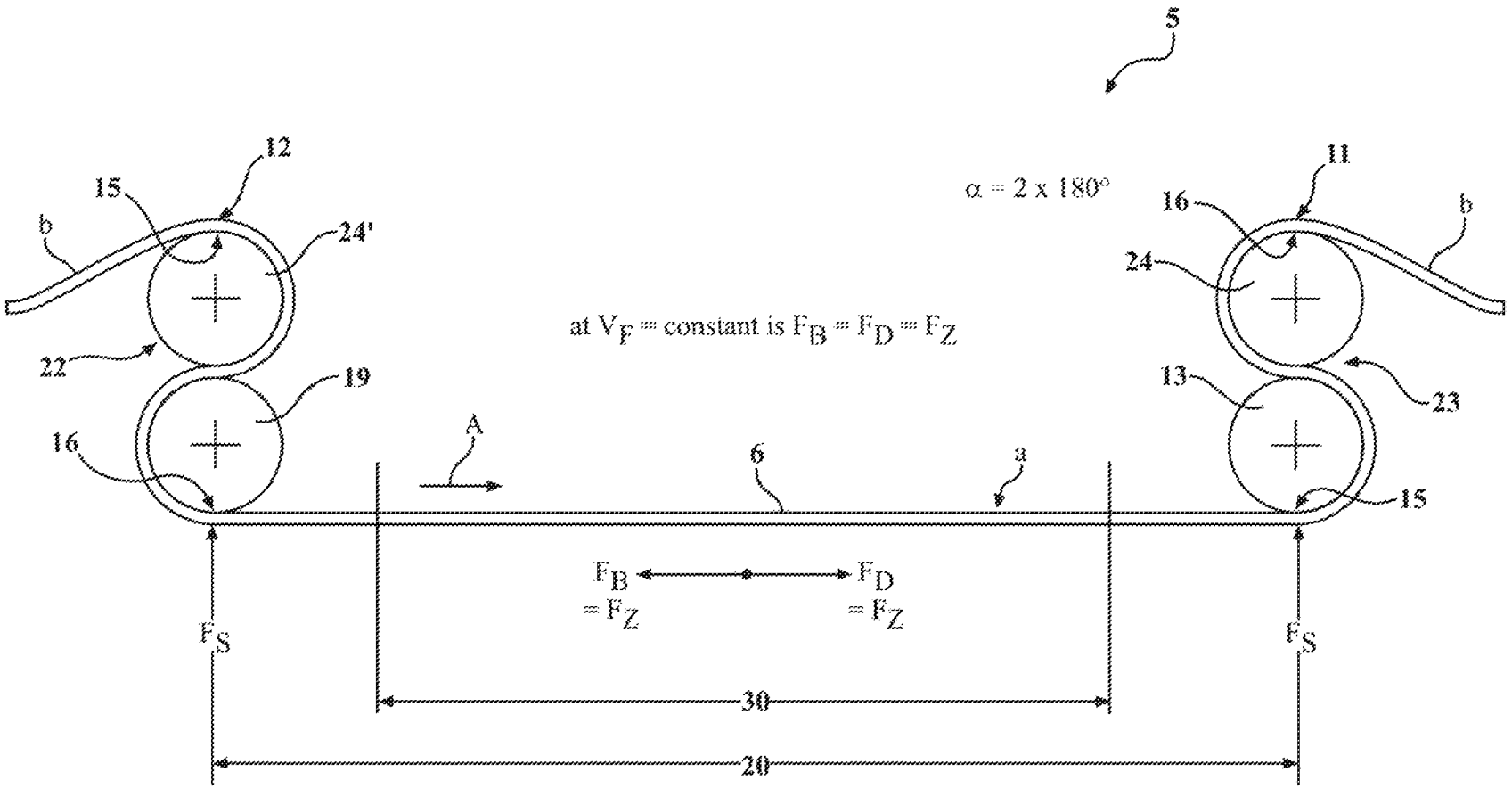
FIG. 1 illustrates a schematic diagram of an S-roller system, as a conveyance system.

Components of the conveyance systems in the following FIGS. 1 to 5 that fulfill the same functions are designated with the same reference numerals and not discussed further.

The S-roller system for tensioning in order to post-treat a rapidly-solidified metal strip according to a comparative example shall be described in greater detail with reference to FIG. 1.

FIG. 1 illustrates a highly simplified schematic diagram of this S-roller system, as a conveyance system 5. In this simplified depiction, only the essential components of the conveyance system 5 are shown, in order to clarify the forces acting on the roller pairs 22 and 23 as well as on the metal strip 6 to be post-treated. Acting on the two roller pairs 22 and 23 before and after the post-treatment region 20 is a contact pressing force $F_s$, which acts on the metal strip 6 between the respective rollers of the roller pairs 22 and 23 and produces a frictional connection between the rollers and the metal strip 6.

While the roller pair 22 of the tensioning assembly 12 at the beginning of the post-treatment region 20 carry out a braking function with a braking force $F_B$ on the metal strip 6 to be post-treated, the roller pair 23 of the tension roller assembly 11 at the end of the post-treatment region generate a driving force $F_D$, which is greater in a start-up phase or acceleration phase at the beginning of conveyance than during the post-treatment phase, during which the metal strip 6 passes through the roller pairs 22 and 23 at a constant speed in the direction of passage A with a tensile force $F_z=F_D=F_B$.

Thus, the known S-roller system provides a conveyance system 5 with which it is possible to continuously post-treat metal alloy strips 6 under tensile stresses in the post-treatment region 20 of up to 1500 MPa. The metal strip 6 is then transported at a constant speed $V_F$ in the direction A. In a region a between the two roller pairs 22 and 23, the metal strip 6 is subjected to an adjustable tensile stress along the strip axis. The tensile stress in the metal strip 6 then arises from the tensile force $F_z$ and the cross-section $A_{Band}$ of the transported metal strip 6, in the entire post-treatment region 20 between the roller pairs 22 and 23. In the region b outside of the S-roller pairs 22 and 23, almost no tensile stress (or a significantly low tensile stress) predominates in the metal strip 6.

Of the two rollers 13 or 19 of each S-roller pair 22 and 23 is driven by a motor having a gear.

The two rollers 13 and 24 or 19 and 24' of each S-roller pair 22 and 23 are mounted so as to be displaceable relative to one another in the vertical direction, and pressed together with an adjustable force $F_S$, so as to apply the adjustable force $F_S$ to the metal strip 6 needing to be post-treated and transported that is between the rollers 13 and 24 or 19 and 24'. This force $F_S$ also acts on the axes of the rollers 24 or 24'. Due to this frictional connection of the two rollers 13 and 24 or 19 and 24' via the force $F_S$ and the metal strip 6 present therebetween, the rollers 24 or 24' of each S-roller pair 22 and 23 also appear to be driven with this known conveyance system 5 through an angle of wrap of 180° per roller. This angle of wrap of two times 180° is a typical feature of the known conveyance system 5.

The schematic diagram of FIG. 1 only indicates that the tensile force $F_z$ in the metal strip 6 is enabled by a braking function of the roller pair 22.

The retraction force can be introduced by various methods, such as, for example, one of the methods disclosed in WO 2013/156010 A1. This braking function can be generated by differences in the torque of the drives of the rollers 13 and 19, or by mechanical braking acting adjustably on one of the rollers of the roller pair 22 of the tensioning assembly 12 before the post-treatment region 20.

Due to the double deflection of the metal strip 6 by 180°, the use of S-roller systems leads to a problem in that the metal alloy strips 6, when used, have a higher frequency of breaks. Passage through the S-roller system leads to breaking in particular with the use of very thin, amorphous Fe-based alloys, which are to be transferred into the nanocrystalline state under tensile stress along the strip axis and at temperatures around 700° C., within a tempering or heat treatment region 30 that is confined from the post-treatment region. When rapidly-solidified metal alloy strips 6 are heat-treated under tensile stress, a thermal relaxation occurs in the nanocrystalline strip material in the tempering or heat-treatment region 30. This can lead to brittling of the material as a whole, or to inhomogeneities in the metal alloy material, with an increased brittleness of the metal strip 6.

The nanocrystalline state is thus more brittle in comparison to the amorphous state, such that the metal alloy strips cannot readily be further bent or cut without fragments occurring. On the other hand, the nanocrystalline strip material can be subjected to very high tensile stresses along the longitudinal strip axis.

Figure 2:
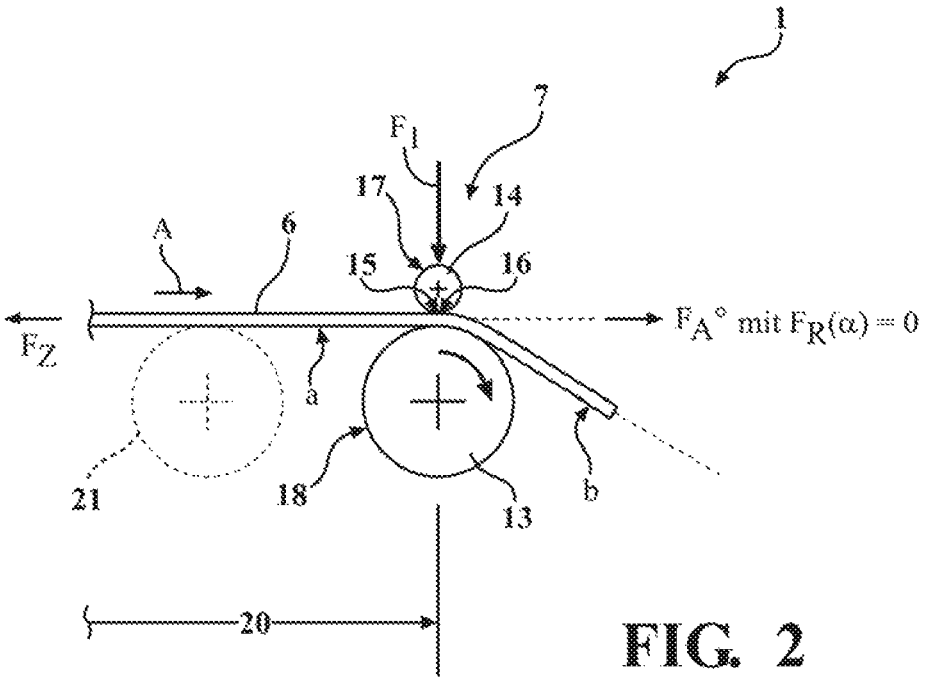
FIG. 2 illustrates a schematic diagram of a conveyance system according to a first embodiment of the invention.

FIG. 2 illustrates a schematic diagram of a conveyance system according to a first embodiment of the invention, which comprises a drive roller 13 corresponding in diameter and in width to the rollers of the S-roller system as illustrated in FIG. 1, and a smaller freely rotating pressing roller 14. The drive roller 13 and the smaller freely rotating pressing rollers 14 form a tension roller assembly 7 of the first embodiment of the invention, at the end of the post-treatment region 20, wherein an associated tensioning assembly 12 at the beginning of the post-treatment region 20 may have an identical roller assembly.

The freely rotating smaller pressing roller then defines the end of an angle of wrap α of the metal strip 6 on the drive roller 13.

The smaller freely rotating pressing roller 14 is pressed with a force $F_1$ onto the continuous metal strip 6, and thus onto the drive roller 13. The contact pressure force $F_1$ acts constantly, and is not dependent on the position. The contact pressure force $F_1$ is in the range of 15 to at most 150 N, and is adapted to the strip width of the continuous metal strip 6, so that a surface pressure of $\sigma_1$ of 7 to 10 MPa occurs, where $\sigma_1=F_1/A_{Abplattung}$ with a flattening surface from $A_{Abplattung}$=strip width [m] times a flattening width of 0.001 m, because the flattening of the drive roller 13 is by about one millimeter.

The drive roller 13 is produced at least in a peripheral region 18 thereof from a flexible plastic material such as FRIBOFLEX, with a high hardness (Shore 90A). The smaller pressing roller 14 is made from a comparatively inelastic material, such as stainless steel, at least in a peripheral region 17 thereof.

The width of the pressing roller 14 is selected so as to fulfill the condition $b_{ra}>b_{r1}>b_{Band}$, where $b_{ra}$ is the width of the drive roller 13, $b_{r1}$ is the width of the pressing roller 14, and $b_{Band}$ is the width of the metal strip 6.

FIG. 2 illustrates only the right-side outgoing part of the conveyance system 1, namely, the tension roller assembly 7 of the first embodiment of the invention. The left-side part of the conveyance system 1, which is optionally located before a heat treatment oven, is constructed analogously to the part of the conveyance system 1 illustrated here. The metal strip 6 passes through the system from left to right in the direction of the arrow A. In the region a, the metal strip 6 is under the tensile force $F_z$. In contrast, in the region b, there is a significantly lower other tensile stress in the strip. The tensile force $F_z$ is applied by a system (not specified in FIG. 2). The direction of the tensile force $F_z$ is always directed opposite to the direction of rotation of the drive roller 13.

The tensile force $F_z$ is necessary, for example, for adjusting the magnetic properties. Through the contact pressure force $F_1$, the material combination of the roller pairing of the drive roller 13 and the pressing roller 14, and the selection of the above-described width condition, the roller system according to the invention made of the rollers 13 and 14 builds a holding force $F_A^0$ that acts opposite to the tensile force $F_z$ and protect the metallic strip from "slipping through" opposite to the direction of travel of the strip. The tensile force $F_z$ can be increased in the strip through a system (not further specified here) up to an equilibrium state $F_z=F_A^0$. In the case where $F_z>F_A^0$, the metal strip 6 "slips" through the roller pair made of the drive roller 13 and pressing roller 14, and the tensile force $F_z$ in the region a can no longer be kept constant.

The conveyance system 1 illustrated in FIG. 2 has a strip angle of wrap $\alpha$=almost 0, because the contact point 15 at the beginning of the angle of wrap $\alpha$ of the metal strip 6 is equal to the contact point 16 at the end of the angle of wrap $\alpha$, which is defined by the pressing roller 14. Forming a sufficiently high holding force $F_A^0$ with this low angle of wrap, which develops only in the region of the flattening of 1 mm of the peripheral region 18 of the drive roller 13, requires a corresponding contact pressure force $F_1$, a corresponding material combination of the roller pairing of the drive roller 13 and the pressing roller 14, and the maintenance of the width condition $b_{ra}>b_{r1}>b_{Band}$.

In the roller pairing according to the invention, made of the drive roller 13 and the pressing roller 14, the tensile force in the metal strip 6 is formed within a very short range of, for example, 1 mm, and corresponding an angle of wrap $\alpha\approx0$, i.e., without any process to bend or curve the metal strip 6. This results in a very low material strain, which is reflected in an improved frequency of breaks. Table 3 shows the results. However, the maximum holding force $F_A^0$ that can be achieved with $\alpha$=0 and the above-mentioned measures is too low for some applications. With an increase in the angle of wrap $\alpha$, the holding force $F_A$ can be increased, such that it is then possible to have higher strip tensions, as illustrated by the following drawings and depicted by table 3 in relation to the increase in the frequency of breaks.

Figure 3:
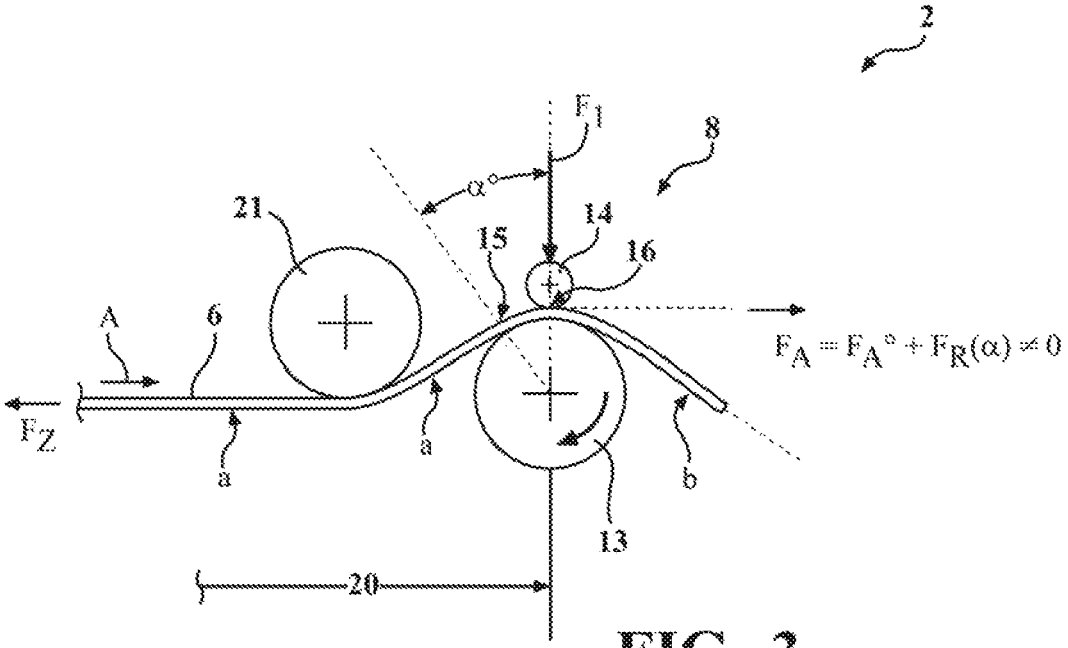
FIG. 3 illustrates a schematic diagram of a conveyance system according to a second embodiment of the invention.

FIG. 3 illustrates a schematic diagram of a conveyance system 2 according to a second embodiment of the invention. The depiction in FIG. 3 is thereby limited to a tension roller assembly 8 of the second embodiment of the invention. In FIG. 3, in order to increase the angle of wrap $\alpha$, a deflection roller 21 that corresponds in diameter and width to the drive roller 13 is used. The deflection roller 21, however, is made out of stainless steel and is freely rotating, like the pressing roller 14. In order to realize different angles of wrap $\alpha$ of the metal strip on the drive roller 13, the position of the deflection roller 21 can be freely selected relative to the drive roller 13.

In FIG. 3, the position of the deflection roller 21 is selected such that the deflection roller 21 defines a first support point 15 of the metal strip 6 on the drive roller, at the start of the angle of wrap $\alpha$, while the end of the illustrated angle of wrap of $\alpha$=25° is defined by the pressing roller 14. Through the angle of wrap $\alpha$ 25° defined by the pressing roller 14, a circumferential path on the drive roller 13 is set, the metal strip 6 being pressed thereon against the drive roller 13, so that an additional static holding force $F_R$ acting in the same direction as the holding force $F_A^0$ is formed from the initial contact point 15 to the contact point 16 at the end of the angle of wrap $\alpha$, which is defined by the pressing roller.

The now effectively acting holding force $F_A$ results from the sum:

$$F_A=F_A^0+F_R \tag{1}$$

The static holding force $F_R$ can be calculated with the aid of the equation (2), as described above. It is thus possible to realize higher tensile forces in the metal strip 6 and, in the magnetic case, to also induce a higher anisotropy, or achieve a lower material permeability. As long as an angle of wrap $\alpha$ that is not too high is selected, there will also be no significant increase in the frequency of breaks, as shown in table 3.

Figure 4:
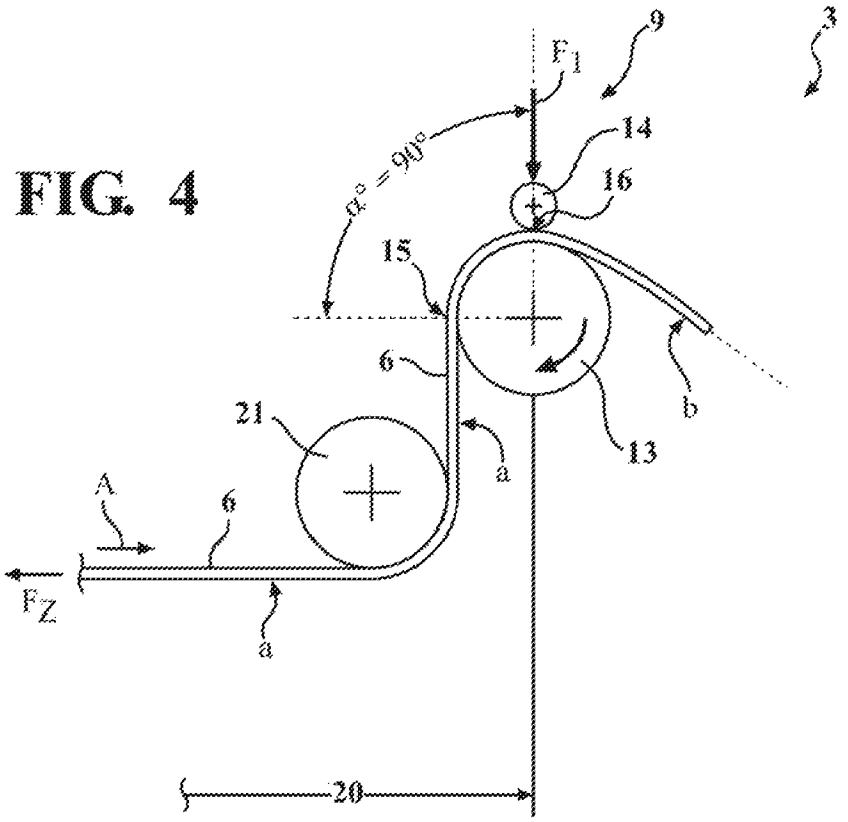
FIG. 4 illustrates a schematic diagram of a conveyance system according to a third embodiment of the invention.

FIG. 4 illustrates a schematic diagram of a conveyance system 3 according to a third embodiment of the invention. The depiction in FIG. 4 is thereby limited to a tension roller assembly 9 of the third embodiment of the invention. As shown in FIG. 4, the metallic freely rotating deflection roller 21 in FIG. 4 is arranged such that the initial contact point 15 of the metal strip 6 on the drive roller 13 is arranged relative to the end of the angle of wrap $\alpha$ defined by the pressing roller 14 such that now an angle of $\alpha$=90° is realized. Nevertheless, this embodiment of the invention does not entail a typical roller system, because the drive roller 13 and the deflection roller 21 do not touch.

In the conveyance system 3 of the third embodiment of the invention, unlike the typical S-roller systems, the range of the very different tension ratios is kept extremely low during the process of bending the metal strip when wrapping around the drive roller 13. Table 1 shows, for example, that the base value of $F_A^0$ can be doubled with an angle of wrap $\alpha$=90°. The effective holding force $F_A$ is then about 166 N, thus coming very close to the targeted maximum tensile force value of $F_z$=170 N.

However, the preferred embodiment range, as already listed above, is at $\alpha$=0 to about 40°, because the consequently achievable maximum tensile forces $F_z$ of ≤120 N are sufficient for magnetic applications. For example, as shown in table 2, a minimum permeability of $\mu=60$ is achieved for an Fe-based alloy (VP800, $Fe_{Rest}$, $Cu_1$, $Nb_3$, $Si_{15.6}$, $B_{6.6}$, at %) at a width of 6 to 12 mm and thickness of 19 μm, which is subjected to a continuous heat treatment in the aforementioned tension range. Table 2 below shows further details.

Figure 5:
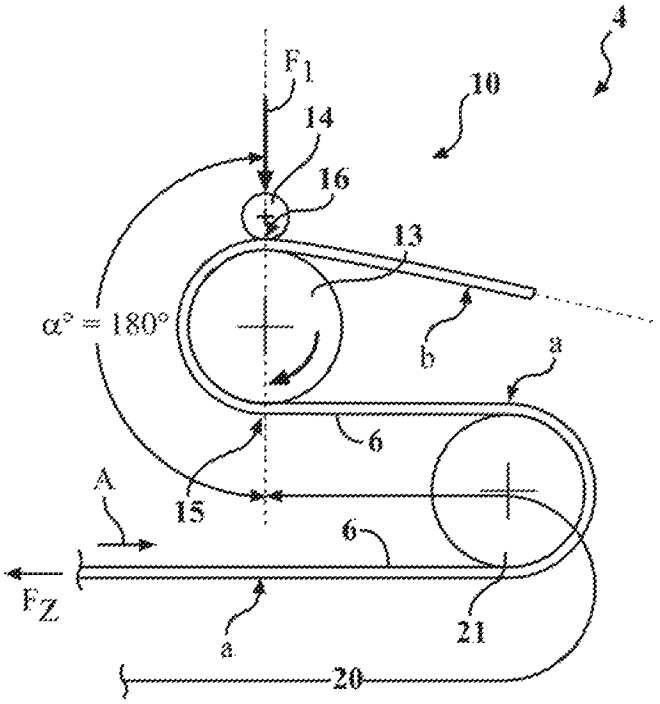
FIG. 5 illustrates a schematic diagram of a conveyance system according to a fourth embodiment of the invention.

FIG. 5 illustrates a schematic diagram of a conveyance system 4 according to a fourth embodiment of the invention. The depiction in FIG. 5 is thereby limited to a tension roller assembly 10 of the fourth embodiment of the invention. In this embodiment, the freely rotating deflection roller 21 is arranged so as to produce an angle of wrap on the drive roller 14 of 180°, wherein, again, the contact point 15 at the beginning of the angle of wrap α is clearly determined by the arrangement of the deflection roller 21 and the contact point at the end of the angle of wrap α=180° is clearly determined by the position of the pressing roller 14.

Nevertheless, this fourth embodiment also does not entail a typical S-roller system, because the drive roller 13 and the deflection roller 21 do not touch, and, unlike the typical S-roller systems, the range of the very different tension ratios here is kept extremely low during the process of bending when the metal strip 6 is wrapped around the drive roller 13. In addition, as shown in table 1, the angle of wrap of 180° results in a static holding force of 129 N, such that an effective holding force $F_A$ of $F_A^0$=80 N+129 N=209 N results, which is well above the desired tensile forces of $F_z$=120 N for magnetic applications.

It should also be noted that the mechanical post-treatment region 20 for the metal strip 6, in which a tensile stress is induced in the metal strip, as illustrated in FIGS. 1 to 5 with the reference numeral 20, is larger than the heat treatment region 30, which is marked only in FIG. 1. The reason is that the tensioning assembly 12 and the tension roller assemblies 7 to 11 are arranged on the outside of a continuous oven or tempering oven.

The following tables 1 to 3 show results in relation to a possible increase of the effectively acting holding force, the achievable permeability, and the number of breaks averaged per 1000 m for different angles of wrap α.

TABLE 1

| α [°] | $(1 - 1/e^{\eta\alpha[rad]})$ | $F_R$ [N] | $F_A = F_A^0 + F_R$ [N] |
|---|---|---|---|
| 0 | 0 | 0 | 80 |
| 25 | 0.13 | 30 | 110 |
| 45 | 0.22 | 51 | 131 |
| 90 | 0.40 | 86 | 166 |
| 180 | 0.63 | 129 | 209 |

Table 1 illustrates the possible increase of the effectively acting holding force $F_A$ with the increase in the angle of wrap α. The base value $F_A^0$ results from the corresponding contact pressure force $F_1$ exerted by the pressing roller 14 at the end of the angle of wrap on the material combination, namely, from the material combination of the roller pairings made of the drive roller 13 as well as the width condition $b_{ra}>b_{r1}>b_{Band}$.

For $F_A^0$, a value of 80 N to 100 N is reached at maximum. 170 N is preferable as a maximally necessary tensile force in the strip. This corresponds, for a metal strip 7 that is 6 to 12 mm wide and 19 μm thick, to a tensile stress of 1500 MPa (where σ=F/A; where σ is tensile stress, F is force, and A is cross-sectional area). $F_z$=170 N was also set as the tensile force for calculating the data in table 1. For the material pairing of the metal strip and the FRIBOFLEX of the drive roller 13, a coefficient of sliding friction of η=0.32 was used.

TABLE 2

| σ [MPa] | Permeability μ | $F_z$ [N] 6 mm, 19 μm | $F_z$ [N] 12 mm, 19 μm |
|---|---|---|---|
| 30 | 1700 | 3.5 | 7 |
| 50 | 1000 | 6 | 12 |
| 200 | 200 | 23 | 46 |
| 500 | 90 | 57 | 114 |
| 750 | 60 | 85 | 170 |

Table 2 shows the achievable permeability (μ) after a continuous heat treatment under tensile stress (σ) for the alloy VP800 ($Fe_{Rest}$, $Cu_1$, $Nb_3$, $Si_{15.6}$, $B_{6.6}$, at %) at a width $b_{Band}$ of the metal strip 6 of 6 to 12 mm and a thickness of the metal strip 6 of 19 μm, with a continuous oven or tempering oven temperature of 690° F. and an annealing or tempering time of 4 s. The required tensile force $F_z$ is also shown in the table, and depends on the strip width $b_{Band}$ of the metal strip 6. A tensile stress of 750 MPa already constitutes a borderline material strain in the heat treatment temperatures used. With tensile stresses above there, the material of the metal strip 6 breaks off after previous elastic deformation and constriction.

TABLE 3

| α [°] | average number of breaks per 1000 m | applicable to σ [MPa] | Notes |
|---|---|---|---|
| 0 | 0.20 | 200 | See FIG. 2 |
| 25 | 0.65 | 400 | See FIG. 3 |
| 45 | 0.85 | 750 | See FIG. 3 |
| 90 | 1.5 | 1500 | See FIG. 4 |
| 180 | 4.0 | 1500 | See FIG. 5 |
| S-rollers | 7 | 1500 | Standard S-roller system (see FIG. 1) |

Table 3 illustrates the probability of a strip break on production lengths of 1 km, on the basis of average numbers of break depending on the angle of wrap α between a first contact point 15 on the drive roller 13 at the beginning of the angle of wrap and a second contact point 16 at the end of the angle of wrap, which is defined by a pressing roller 14. As shown in table 3, the averaged number of breaks per 1000 m clearly falls below 1 as the angle of wrap α decreases, as long as the new conveyance system is used in the preferable angle-of-wrap range of α[°]=0 to α[°]=40°.

LIST OF REFERENCE SIGNS

1 Conveyance system (first embodiment)
2 Conveyance system (second embodiment)
3 Conveyance system (third embodiment)
4 Conveyance system (fourth embodiment)
5 Conveyance system (prior art)
6 Metal strip
7 Tension roller assembly (first embodiment)
8 Tension roller assembly (second embodiment)
9 Tension roller assembly (third embodiment)
10 Tension roller assembly (fourth embodiment)
11 Tension roller assembly (prior art)
12 Tensioning assembly
13 Drive roller
14 Pressing roller
15 Contact point at the beginning of the angle of wrap
16 Contact point at the end of the angle of wrap
17 Peripheral region of 14
18 Peripheral region of 13
19 Brake roller

20 Post-treatment region
21 Deflection roller
22 Roller pair
23 Roller pair
24 24' Second rollers of the roller pairs
30 Tempering or heat treatment region
A Direction of passage of the metal strip
$b_{RA}$ Width of the drive roller
$b_{R1}$ Width of the pressing roller
$b_{Band}$ Width of the metal strip
$F_A$ effective force acting on the metal strip
$F_A^0$ holding force acting on the metal strip at $\alpha=0$
$F_D$ Driving force
$F_B$ Braking force
$F_1$ Contact pressure force
$F_R$ Frictional force (static friction)
$F_S$ Force on an S-roller pair assembly
$F_Z$ Tensile force on the metal strip
$\alpha$ Angle of wrap of the metal strip
$\alpha$[°] Angle of wrap, in degrees
$\alpha$[rad] Angle of wrap, in radians

The invention claimed is:

1. A conveyance system for tensioning in order to post-treat a metal strip, comprising:
a tension roller assembly, and
a tensioning assembly,
wherein the tension roller assembly comprises a single drive roller and a freely rotating pressing roller,
wherein the metal strip is conveyed between the tensioning assembly and the tension roller assembly in order to be continuously post-treated under tension, and the metal strip is conveyed over an angle of wrap $\alpha$ on the drive roller; and
wherein, in relation to the drive roller, the pressing roller is arranged at a contact point of the metal strip that defines an end of an angle of wrap $\alpha$.

2. The conveyance system according to claim 1, wherein the angle of wrap $\alpha$ of the metal strip on the drive roller comprises between 0 and 180°.

3. The conveyance system according to claim 1, wherein the angle of wrap $\alpha$ of the metal strip on the drive roller comprises between 0 and 40°.

4. The conveyance system according to claim 1, wherein the pressing roller is arranged so as to be freely rotating on the contact point of the metal strip at the end of the angle of wrap $\alpha$ on the drive roller.

5. The conveyance system according to claim 1, wherein the drive roller has a width $b_{RA}$, the pressing roller has a width $b_{R1}$, and the metal strip has a width $b_{Band}$, and this widths ($b_{Ra}$, $b_{R1}$, $b_{Band}$) are in the following relationship to one another: $b_{Ra}>b_{R1}>b_{Band}$.

6. A conveyance system for tensioning in order to post-treat a metal strip, comprising:
a tension roller assembly, and
a tensioning assembly,
wherein the tension roller assembly comprises a single drive roller and a freely rotating pressing roller,
wherein the metal strip is conveyed between the tensioning assembly and the tension roller assembly in order to be continuously post-treated under tension, and the metal strip is conveyed over an angel of wrap $\alpha$ on the dive roller; and
wherein, in relation to the dive roller, the pressing roller is arranged at a contact point of the metal strip that defines an end of an angle of wrap $\alpha$, wherein the angle of wrap $\alpha$ of the metal strip on the drive roller comprises between 0 and 40°.

7. A conveyance system for tensioning in order to post-treat a metal strip, comprising:
a tension roller assembly, and
a tensioning assembly,
wherein the tension roller assembly comprises a single drive roller and a freely rotating pressing roller,
wherein the metal strip is conveyed between the tensioning assembly and the tension roller assembly in order to be continuously post-treated under tension, and the metal strip is conveyed over an angle of wrap $\alpha$ on the drive roller; and
wherein, in relation to the drive roller, the pressing roller is arranged at a contact point of the metal strip that defines an end of an angle of wrap $\alpha$, wherein the drive roller has a width $b_{RA}$, the pressing roller has a width $b_{R1}$, and the metal strip has a width $b_{Band}$, and these widths ($b_{Ra}$, $b_{R1}$, $b_{Band}$) are in the following relationship to one another: $b_{Ra}>b_{R1}>b_{Band}$.

8. A conveyance system for tensioning in order to post-treat a metal strip, comprising:
a tension roller assembly, and
a tensioning assembly,
wherein the tension roller assembly comprises a single drive roller and a freely rotating pressing roller,
wherein the metal strip is conveyed between the tensioning assembly and the tension roller assembly in order to be continuously post-treated under tension, and the metal strip is conveyed over an angle of wrap $\alpha$ on the drive roller; and
wherein, in relation to the drive roller, the pressing roller is arranged at a contact point of the metal strip that defines an end of an angle of wrap $\alpha$,
wherein the tensioning assembly has a braking function, the tensioning assembly includes a pressing roller having a construction identical to the pressing roller of the tension roller assembly, and the tensioning assembly has a brake roller of the same material and same size as the drive roller of the tension roller assembly.

9. The conveyance system according to claim 8, wherein the pressing rollers have a contact pressure force in the range of 15 to 150 N with surface pressures 7 to 10 MPa acting on the drive roller and/or the brake roller.

10. A conveyance system for tensioning in order to post-treat a metal strip, comprising:
a tension roller assembly, and
a tensioning assembly,
wherein the tension roller assembly comprises a single drive roller and a freely rotating pressing roller,
wherein the metal strip is conveyed between the tensioning assembly and the tension roller assembly in order to be continuously post-treated under tension, and the metal strip is conveyed over an angle of wrap $\alpha$ on the drive roller; and
wherein, in relation to the drive roller, the pressing roller is arranged at a contact point of the metal strip that defines an end of an angle of wrap $\alpha$,
wherein the tensioning assembly has deflection rollers that transfer a force of gravity of a predetermined weight to the metal strip as a constant tensile force.

11. A conveyance system for tensioning in order to post-treat a metal strip, comprising:
a tension roller assembly, and
a tensioning assembly,
wherein the tension roller assembly comprises a single drive roller and a freely rotating pressing roller,
wherein the metal strip is conveyed between the tensioning assembly and the tension roller assembly in order to be continuously post-treated under tension, and the metal strip is conveyed over an angle of wrap α on the drive roller; and wherein, in relation to the drive roller, the pressing roller is arranged at a contact point of the metal strip that defines an end of an angle of wrap α, wherein the conveyance system made of the tensioning assembly and the tension roller assembly can be controlled so as to form a tensile stress of up to 1500 MPa on the metal strip.

12. A system for post-treating a rapidly-solidified metal strip, comprising:

a conveyance system for tensioning in order to post-treat a metal strip, comprising:

a tension roller assembly, and a tensioning assembly, wherein the tension roller assembly comprises a single drive roller and a freely rotating pressing roller, wherein the metal strip is conveyed between the tensioning assembly and the tension roller assembly in order to be continuously post-treated under tension, and the metal strip is conveyed over an angle of wrap α on the drive roller; and wherein, in relation to the drive roller, the pressing roller is arranged at a contact point of the metal strip that defines an end of an angle of wrap α; and a continuous furnace for heat-treating the metal strip, wherein the tensioning assembly is arranged before the continuous furnace in a direction of passage and the tension roller assembly is arranged after the continuous furnace.

* * * * *